US007771253B2

(12) United States Patent
Wuensch

(10) Patent No.: US 7,771,253 B2
(45) Date of Patent: Aug. 10, 2010

(54) HAND-GUIDED SANDER, SANDER CRADLE, AND SANDER HOUSING

(75) Inventor: Steffen Wuensch, Holzgerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 289 days.

(21) Appl. No.: 10/594,286

(22) PCT Filed: Feb. 21, 2005

(86) PCT No.: PCT/EP2005/050746

§ 371 (c)(1),
(2), (4) Date: Jul. 1, 2008

(87) PCT Pub. No.: WO2005/108010

PCT Pub. Date: Nov. 17, 2005

(65) Prior Publication Data

US 2008/0254721 A1 Oct. 16, 2008

(30) Foreign Application Priority Data

Apr. 1, 2004 (DE) ..... 10 2004 016 015

(51) Int. Cl.
*B24B 23/04* (2006.01)

(52) U.S. Cl. ..... 451/344; 451/354; 451/356; 451/357

(58) Field of Classification Search ..... 451/344, 451/354, 356, 357, 358, 359, 523
See application file for complete search history.

(56) References Cited

U.S. PATENT DOCUMENTS

| | | | | |
|---|---|---|---|---|
| 3,444,576 | A * | 5/1969 | Daane | 15/28 |
| 4,005,502 | A | 2/1977 | Stevens (Boyer) | |
| 4,625,462 | A | 12/1986 | Fushiya et al. | |
| 5,533,843 | A | 7/1996 | Chung | |
| 5,709,596 | A * | 1/1998 | Alexander et al. | 451/357 |
| 5,716,263 | A | 2/1998 | Jones et al. | |
| D435,768 | S * | 1/2001 | Duffy | D8/62 |
| 6,179,696 | B1 * | 1/2001 | Duffy | 451/357 |
| 6,846,230 | B2 | 1/2005 | Jonas | |
| 7,313,838 | B2 * | 1/2008 | Long et al. | 15/22.2 |
| RE40,345 | E * | 5/2008 | Duffy | 451/357 |
| 7,371,150 | B2 * | 5/2008 | Deshpande et al. | 451/5 |
| 7,476,144 | B2 * | 1/2009 | Dineen et al. | 451/8 |
| 7,485,026 | B2 * | 2/2009 | King | 451/8 |
| 7,565,712 | B2 * | 7/2009 | Long et al. | 15/22.2 |
| 2002/0134811 | A1 | 9/2002 | Napier et al. | |
| 2003/0041717 | A1 | 3/2003 | Evenson | |
| 2003/0167585 | A1 | 9/2003 | Chen | |

FOREIGN PATENT DOCUMENTS

| | | |
|---|---|---|
| EP | 0 232 761 | 8/1987 |
| EP | 0 610 801 | 8/1994 |
| GB | 2 380 440 | 4/2003 |
| WO | 02/053321 | 7/2002 |
| WO | 2004/049886 | 6/2004 |

* cited by examiner

*Primary Examiner*—Timothy V Eley
(74) *Attorney, Agent, or Firm*—Michael J. Striker

(57) ABSTRACT

The invention is based on a hand-guided sander having a housing (12) whose size is essentially limited to that of a base (38) of a sanding plate (30).

According to the invention, the housing (12) is equipped to accommodate a rechargeable battery unit (28). The invention also relates to a sander cradle and a sander housing.

12 Claims, 6 Drawing Sheets

HAND-GUIDED SANDER, SANDER CRADLE, AND SANDER HOUSING

CROSS-REFERENCE TO RELATED APPLICATION

The invention described and claimed hereinbelow is also described in German Patent Application DE 10 2004 016 015.5 filed on Apr. 1, 2004. This German Patent Application, whose subject matter is incorporated here by reference, provides the basis for a claim of priority of invention under 35 U.S.C. 119(a)-(d).

BACKGROUND OF THE INVENTION

Hand-guided sanders such as orbital sanders or delta sanders are known. Devices of this kind are heavy and in some cases, have a high center of gravity, which makes the sander harder to operate.

SUMMARY OF THE INVENTION

The invention is based on a hand-guided sander having a housing whose size is essentially limited to that of the base of the sanding plate. It is preferable for the housing to be equipped to accommodate a rechargeable battery unit. Preferably, the housing has a receptacle to accommodate a rechargeable battery unit with one or more rechargeable batteries. Preferably, the housing contains at least one motor, a sanding drive unit for a sanding plate, the rechargeable battery unit, and an electronic unit, thus comprising a very compact, easy-to-operate sander. The sander is easier to use thanks to its low center of gravity. The available sanding surface area is large in comparison to the compact housing size. A suitable matching of the components such as the motor, the rechargeable battery unit, and the sanding block makes it possible to achieve high performance at a low weight. It is useful for the rechargeable batteries to be aligned parallel to one another and parallel or slightly inclined in relation to the sanding plate. The motor is preferably a direct current motor, typically with an operating voltage of between 7.2 volts and 14.4 volts. Optionally, the sander can also be designed to operate on power grid current. For the sake of convenience, it is particularly advantageous to operate the sander cordlessly since its operation is then unhindered by a cable that must be managed and the user can work without being troubled. It is also possible to eliminate the weight of the transformer and cable, which further improves operation and reduces weight.

For flexible use, the sander should be designed so that it can be operated either cordlessly or on current from the power grid.

A particularly compact design with high sanding power can be achieved if lithium-ion cells are used as the cells of the rechargeable battery unit. Using a rechargeable battery unit that is equipped with lithium-ion cells and has an output voltage in the neighborhood of 7.2 volts strikes a favorable balance between the arrangement and number of rechargeable cells in the rechargeable battery unit and the power these cells deliver. If a particularly high sanding power in cordless operation is required, then it is favorable to use a lithium-ion cell rechargeable battery unit with an output power of 10.8 volts.

The sander can be particularly convenient to use if the vertical height of the housing perpendicular to the base is at most as great as its longitudinal span along the base. This situates the center of gravity in an advantageously low position close to the sanding plate. Preferably, the sanding plate has a tip that facilitates access to corners and edges. It is particularly advantageous for the sanding plate to be delta-shaped or to be comprised of two delta-shaped surfaces that adjoin each other along their bases.

If the sanding plate is integrally joined to its support flange, to oscillation feet, and to their mounts oriented toward the housing, then this makes it particularly inexpensive to produce and facilitates its installation.

In a preferred embodiment, a favorable balance among sanding power, convenience, weight, and costs is struck if, in the preferred mid-level operating voltages, the motor is oriented perpendicular to the sanding plate. At an advantageous operating voltage of approximately seven volts, the height of the motor is relatively low, allowing the motor to be installed into the low housing of the sander in a perpendicular orientation. In the operating voltage range mentioned above, a favorable sanding power is achieved in the form of a maximum sanding time on a single battery charge, with an acceptable motor and battery size, which also permits the components to be of a convenient size. A space-saving arrangement with a perpendicularly oriented motor is achieved if an electronic unit is oriented with a flat side parallel to the sanding plate.

In terms of weight, it is also advantageous for a sanding block attached to the sanding plate to be designed to accommodate a sanding disk made of an elastomer such as rubber or foam rubber. It is also optionally possible to use cork. Moreover, with a vertically installed motor, it is possible to provide an inexpensive transmission embodied in the form of a pair of spur gears. The transmission can reduce a bearing load on the sanding plate.

In order on the one hand to permit the motor to be operated in an advantageous efficiency range and on the other hand to permit an oscillation rate of marginally higher than 10,000/min, the transmission appropriately has a ratio of at most i=3, particularly preferably of i=2. The motor speed of 20,000 rpm thus achieved lies in a speed range that is suitable for such motors.

If a higher sanding power is required, then in another preferred embodiment, it is advantageous to orient a motor parallel to the sanding plate. This makes it possible to use both a larger, more powerful motor and a larger-capacity rechargeable battery unit. Then it is also advantageous to orient an electronic unit with a flat side perpendicular to the sanding plate. Then a transmission between the motor and the sanding drive unit with can be suitably embodied in the form of a pair of bevel gears.

In advantageous modification of the invention, the housing has an electrical connection for attachment to a charger. Then when the rechargeable battery unit has been drained, it remains in the housing and is recharged.

If the electrical connection is designed to assure that an operating voltage is supplied in at least one operating mode, then it is possible for the sander to be operated even when the rechargeable battery unit has been drained. In this case, the electrical connection can either be connected to a charger or connected to a power cable and in a particularly advantageous design, can include a switching device, which, whenever the power cable is plugged in, automatically switches the sander into an operating mode in which the sander draws its operating current from the power grid. It is also conceivable for a transformer, which is suitable for charging the rechargeable battery unit, to be integrated into the housing so that the rechargeable battery unit automatically recharges whenever the power cable is attached.

The present invention also relates to a sander cradle that is provided with a connection for attachment to a charger that can be activated when the sander is inserted into it. The sander can then be stored in the cradle during short pauses in operation and recharged at the same time. The sander can be hung onto the cradle or slid into it for storage purposes, for recharging purposes, and/or for temporarily storing it during pauses while sanding.

It is advantageous for the sander cradle to be provided with a holder for sanding accessories such as sheets of sandpaper and the like.

The present invention also relates to a sander housing for containing at least one motor, a sanding drive unit for a sanding plate, and an electronic unit, and having a base to be attached to a sanding plate, whose longitudinal span is at least as great as a height of the housing perpendicular to the base and has a receptacle for a rechargeable battery unit. This achieves a compact, easy-to-use, attractive housing, particularly when the rechargeable battery unit has lithium-ion cells.

In one advantageous embodiment, the sander housing is divided into a first and second half of the housing casing in which means are provided for holding a motor and/or an electronic unit and/or the rechargeable battery unit and/or a transmission and/or a sanding drive unit for a sanding plate, which are inserted into one or both of the casing halves of the housing. This simplifies assembly of the sander. Preferably, a dust seal is provided between the electrical and mechanical components in the sander housing.

Other advantages ensue from the following description of the drawings. The drawings depict exemplary embodiments of the invention. The drawings, the description, and the claims contain numerous defining characteristics in combination. Those skilled in the art will also suitably consider the defining characteristics individually and unite them in other meaningful combinations.

DESCRIPTION OF THE PREFERRED EMBODIMENTS

Figure 1:
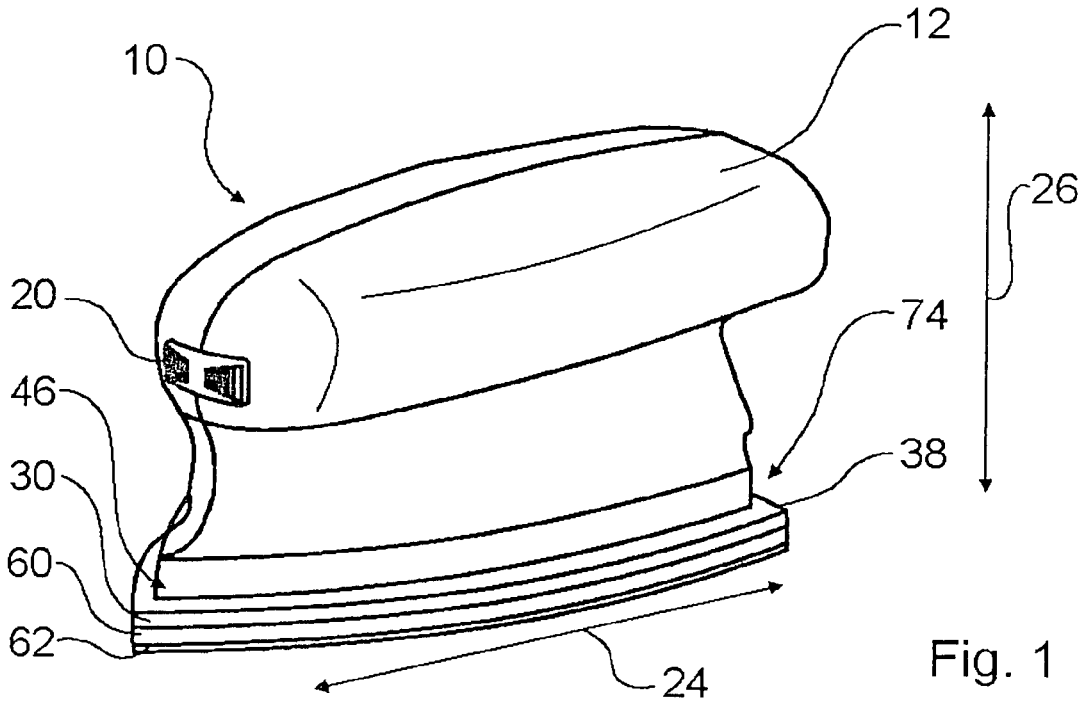
FIG. 1 is a general view of a preferred sander.

In the drawings, parts that remain essentially the same are basically provided with the same reference numerals. FIG. 1 shows a view of a preferred hand-guided sander 10. The sander 10 has a relatively flat housing 12 that sits above a sanding plate 30. The underside of this sanding plate 30 is provided with a sanding block 60 that is covered with a piece of sandpaper 62. Preferably, the sanding block 60 is comprised of closed-cell foam. The housing 12 is limited in size to essentially that of a base 38 of the sanding plate 30. Essentially all of the components of the sander 10 contained in the housing 12 are situated above a base 46 of the housing 12. In its height 26 of the housing 12 perpendicular to the base 38 is at most as great as its maximum longitudinal span 24 along the base 38. In the upper region, the housing 12 juts out at a blunt end 74 of the sanding plate 30 and the housing 12 widens out at the top so that the sander 10 can be guided snugly and securely in the operator's hand. At its end, the housing 12 has a switching mechanism 20, for example a contact button, a sliding switch, or the like, that can be used to switch a motor, not shown, of the sander 10 on and off.

Figure 2:
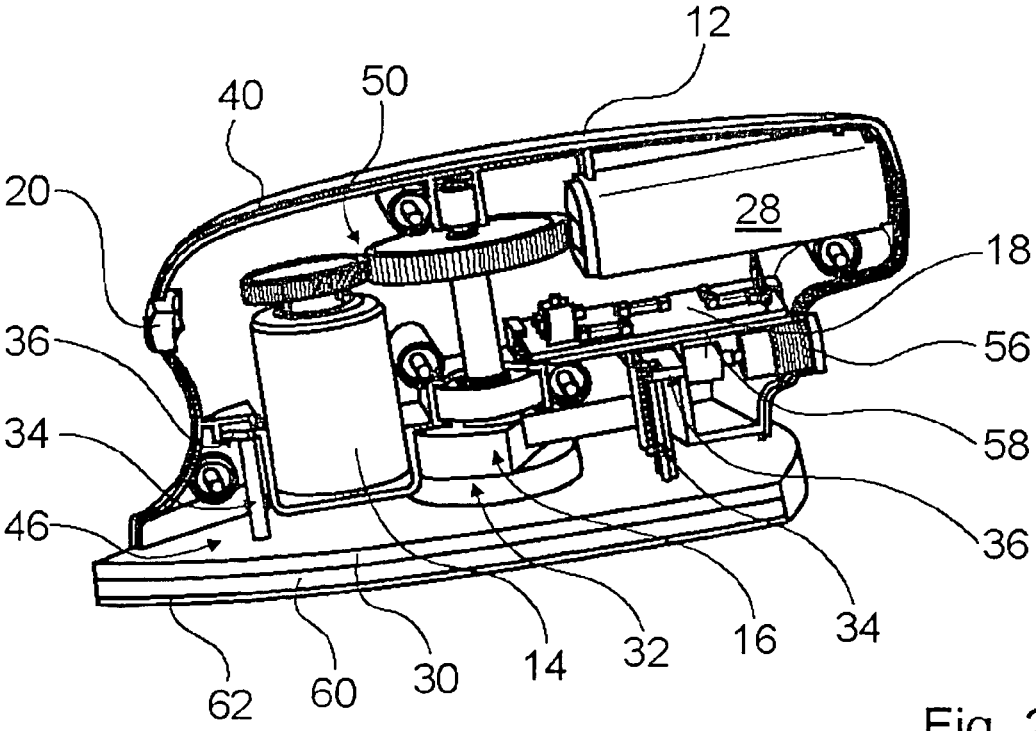
FIG. 2 is a view of a first preferred embodiment of the sander with a cutaway view of the housing in which a motor is oriented perpendicular to a sanding plate and in which a sanding plate drive unit is situated between the motor and the rechargeable battery.

FIG. 2 shows a preferred sander 10 with a cutaway view of the housing 12. The housing 12 contains a motor 14, a sanding drive unit 16 for a sanding plate 30, and an electronic unit 18. On its underside, the sanding plate 30 is attached to a sanding block 60 with a sheet of sandpaper 62 mounted onto it. The motor 14 is oriented perpendicular to the sanding plate 30 and drives the sanding drive unit 16 by means of a transmission 50 embodied in the form of a pair of spur gears. The sanding drive unit 16 is supported on a support flange 32 of the sanding plate 30. The motor 14 and the sanding drive unit 16 equipped with the support flange 32 are situated between oscillation feet 34 connected to the sanding plate 30. At their ends oriented away from the sanding plate 30, the oscillation feet 34 have mounts 36 oriented toward the housing, with which they are movably supported in the housing 12. The support flange 32 is situated to the right of a center of mass of the sanding plate 30 and is situated between the motor 14 and a rechargeable battery unit 28.

On the front and back of the housing 12 and also on its sides, each surface is provided with indentations that permit the user to conveniently guide the sander 10 with one or both hands.

An electronic unit 18, in particular a circuit board equipped with electrical components, is oriented with a flat side 58 parallel to the sanding plate 30.

A rechargeable battery unit 28 is situated above the electronic unit 18 and next to the transmission 50 and is comprised of two parallel rechargeable batteries that are oriented approximately parallel to the sanding plate 30. It is advantageous to use two rechargeable batteries with a total voltage of 7.2 volts. The rechargeable battery unit 28 is connected to the electronic unit 18 via cables, not shown, and plug connectors that allow it to be replaced when the unit is being serviced, but can also be electrically contacted by means of a spring contact connection similar to the kind used in flashlights and the like. The rechargeable battery unit 28 can be easily replaced as needed. Preferably, the rechargeable battery unit 28 is a battery pack with lithium-ion cells.

An electrical connection 56, which is connected to the electronic unit 18 and is embodied in the form of a coupling socket, is provided on the back the housing 12 and is for connecting to a charger, not shown, in order to recharge the battery unit 28. In addition, a charge indicator can be provided on the housing 12, situated in a location that is useful to an operator, as close as possible to the electronic unit 18. Preferably, a two-colored light-emitting diode unit is used for this purpose, which signals that a charge is required in a first color, e.g. orange, and signals that a recharging procedure has finished in a second color, e.g. green. When the sander 10 is switched on, the light-emitting diode unit suitably goes out.

The housing 12 is comprised of two casing halves, of which only one casing half 40 is shown in FIG. 2. Inside the housing 12, there are mounts into which the components can be inserted in the housing 12. On its backside, the housing 12 provided with means that allow the rechargeable battery unit 28 to be removed.

Figure 3:
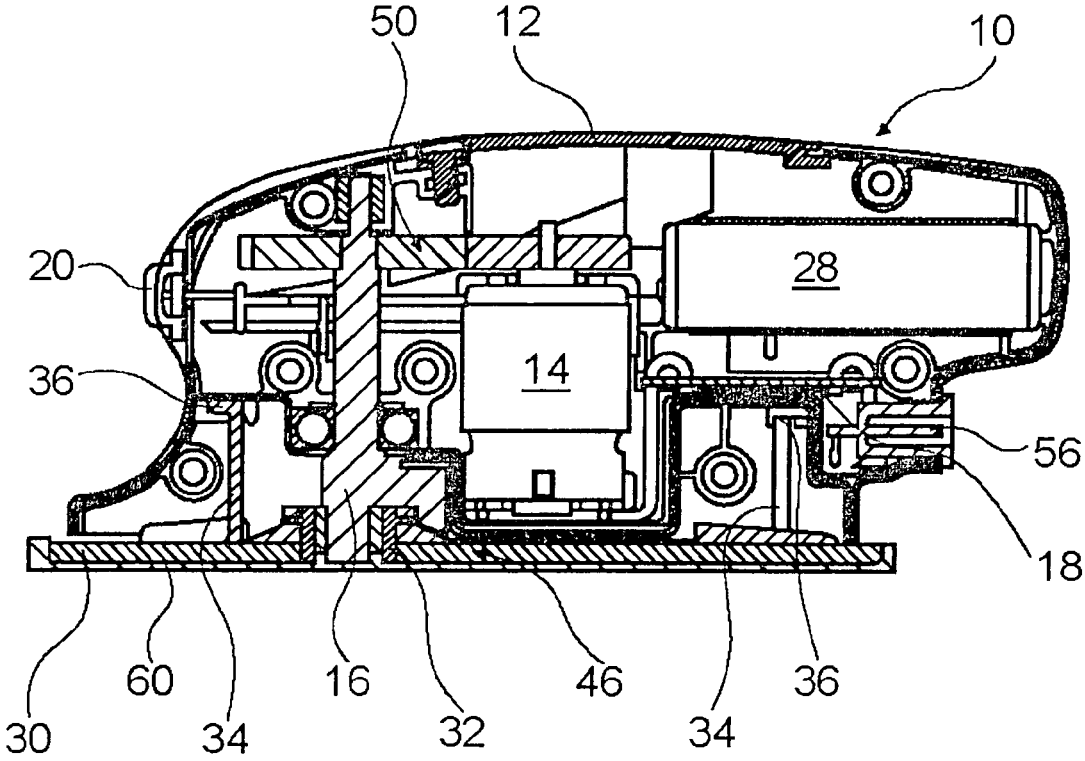
FIG. 3 is a cross section through the sander, in which the motor is oriented perpendicular to the sanding plate and in which the motor and rechargeable battery are situated next to a sanding plate drive unit.

FIG. 3 shows a cross section through a sander 10 in which a sanding drive unit 16 is alternatively situated to the side of a motor 14 so that the sanding drive unit 16 is located to the left of a center of mass of the sanding plate 30. As a result, the motor 14 and the rechargeable battery unit 28 are each situated on a respective side of the sanding drive unit 16.

Figure 4:
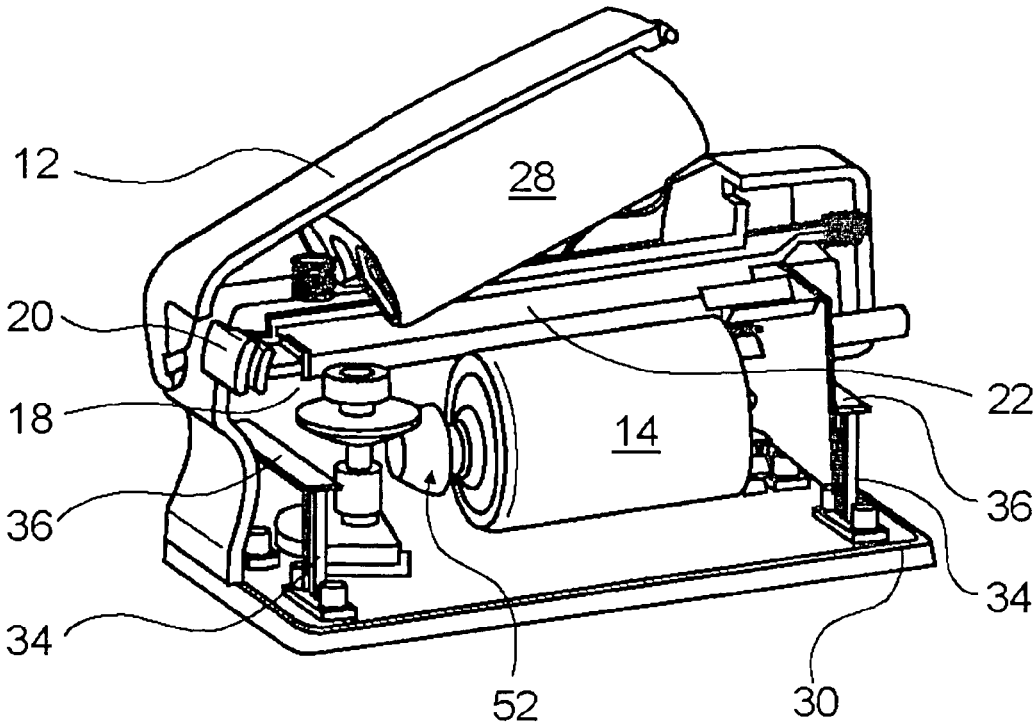
FIG. 4 is a view of an alternative sander with a cutaway view of the housing in a first preferred embodiment, in which the motor is oriented parallel to the sanding plate, FIGS. 5 *a, b, c*, and *d* show four variants for supporting a sanding plate, FIGS. 6 *a* and *b* show a preferred sanding plate in a diagonal view from underneath (a) and in a view from above (b), FIGS. 7 *a* and *b* show a view of a housing with a divided plastic casing half (a) and a view of the housing from behind (b)
Figure 5A:
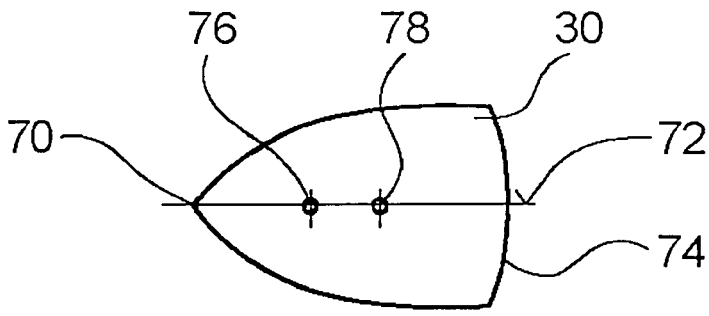
Figure 5B:
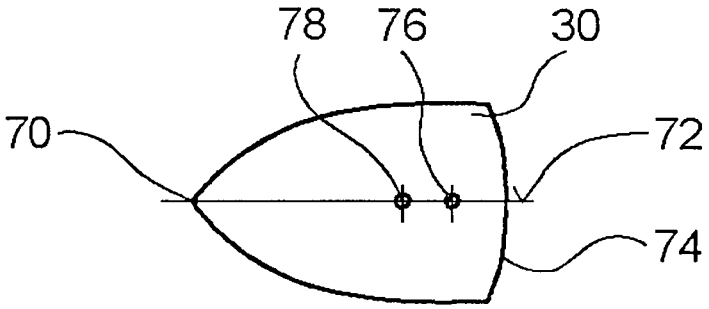
Figure 5C:
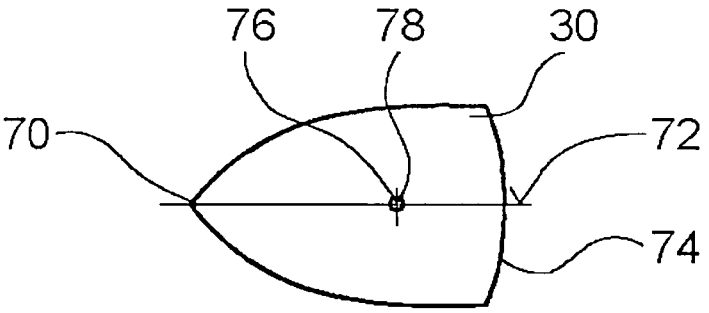
Figure 5D:
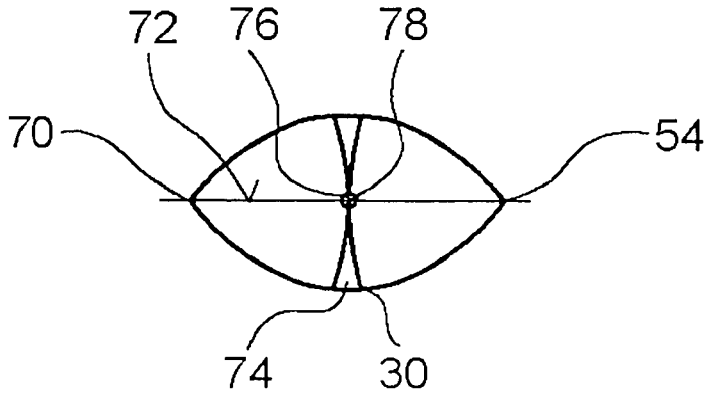

FIG. 4 shows a view of a preferred sander 10 with an open housing 12 in which a motor 14, which is oriented in a supine position and has a transmission 52 embodied in the form of a pair of bevel gears, drives a sanding drive unit 60 of a sanding plate 30. With regard to features and functions that remain unchanged, reference is hereby made to the description of the exemplary embodiment shown in FIGS. 2 and 3. This design is suitable for higher sanding powers in which the motor 14 must produce a higher output and a more powerful rechargeable battery unit 28 is required, both of which correspondingly increase its overall size. At its front end, the housing 12 has a switch mechanism 20 that causes a switching rod 22 to actuate a switch embodied in the form of a pressure switch on an electronic unit 18. The rechargeable battery unit 28 is situated above the switching rod 22 and is inclined at a slight angle in relation to the sanding plate 30.

The sanding plate 30 is preferably embodied with a tip 70 and is in particular delta-shaped. With regard to the allocation of a support point 76 for a support flange 32 that constitutes a support for the sanding plate 30, there are fundamentally a three variants, provided that the sanding drive unit 16 is situated on a symmetry axis 72 of the sanding plate 30. These variants are shown in FIGS. 5 *a, b, c*, and *d*.

Starting from the tip 70 from which the symmetry axis 72 of the sanding plate 30 extends, the support point 76 can lie between the tip 70 and a center of mass 78 (FIG. 5 *a*). Alternatively, the support point 76 can lie between the center of mass 78 and a blunt end 74 of the sanding plate 30 (FIG. 5 *b*). In these two embodiments, each point on the sanding plate 30 or each sanding granule of a piece of sandpaper attached to the plate describes its own individual curved path. The movements of the sanding granules are largely elliptical, the size of the ellipses increasing with the distance from the sanding drive unit 16 (FIG. 3). But the ratio of their semiaxes changes constantly. Their greatest ratio is found at the periphery of the sanding plate 30. In the arrangement in FIG. 5 *a*, the tip 70 of the sanding plate 30 moves on an elliptical path whose major semiaxis is oriented transversely in relation to the symmetry axis 72 of the sanding plate 30. In the arrangement according to FIG. 5 *b*, the tip 70 moves in the direction of the symmetry axis 72. Both embodiments have the advantage that the different movements at every point of the sanding plate 30 produce a very good sanding pattern. The arrangement according to FIG. 5 *b* has the additional advantage that the ellipse oriented in the direction of the symmetry axis 72 has very good properties for sanding in corners.

The arrangement in FIG. 5 *c* alternatively shows a support of the sanding plate 30 at the center of mass 78 and strikes a useful compromise between curved paths of the sanding granules and positive aspects with regard to a counterbalancing of the sanding plate 30. The curved paths of the sanding granules approximate a circle at each point of the sanding plate 30 and permit a low-vibration operation. In addition, this corresponds to a conventional design of the sanding plate 30.

In the arrangement in FIG. 5 *d*, the sanding drive unit 16 is situated at the center of mass 78 of a biaxially symmetrical sanding plate 30 on which two delta-shaped sheets of sandpaper are joined at their blunt ends 74 and whose symmetry axis 72 passes through the two tips 70, 54. This design makes it particularly convenient for the sander 10 to access corners and edges, makes the sander easy to maneuver, and makes good use of the two symmetrically mounted delta-shaped sheets of sandpaper. The arrangement can be easily counterbalanced to good effect. An advantageous arrangement and number of oscillation feet 34 can be calculated using a conventional force calculation program.

Figure 6A:
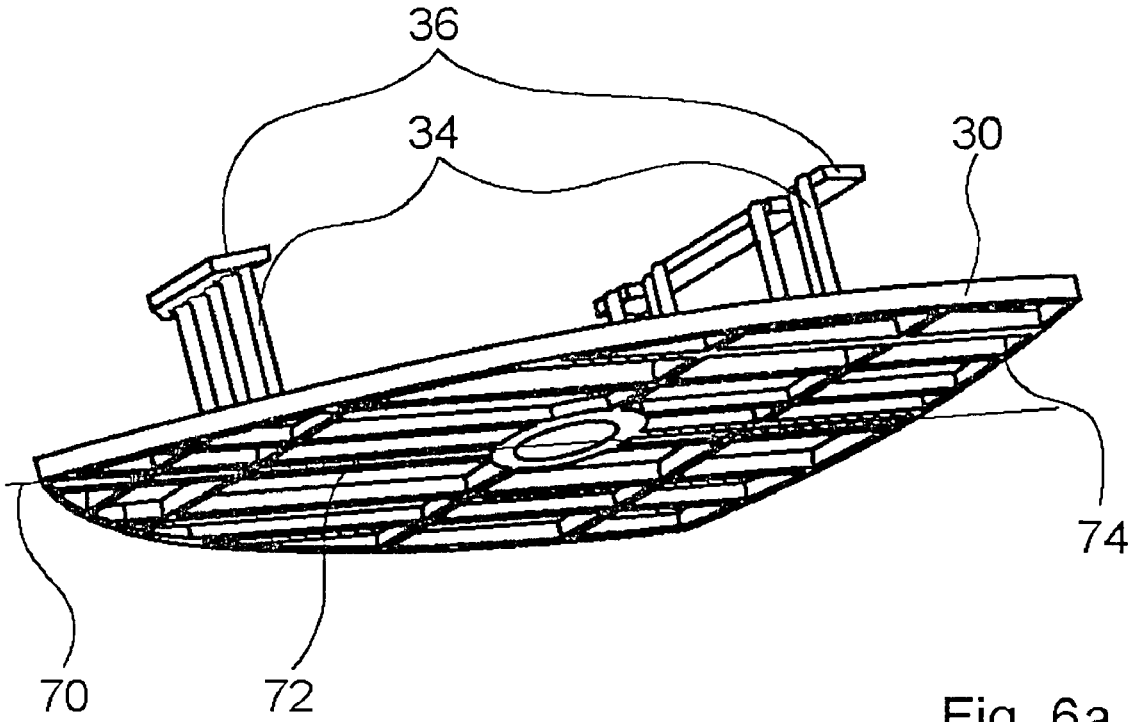
Figure 6B:
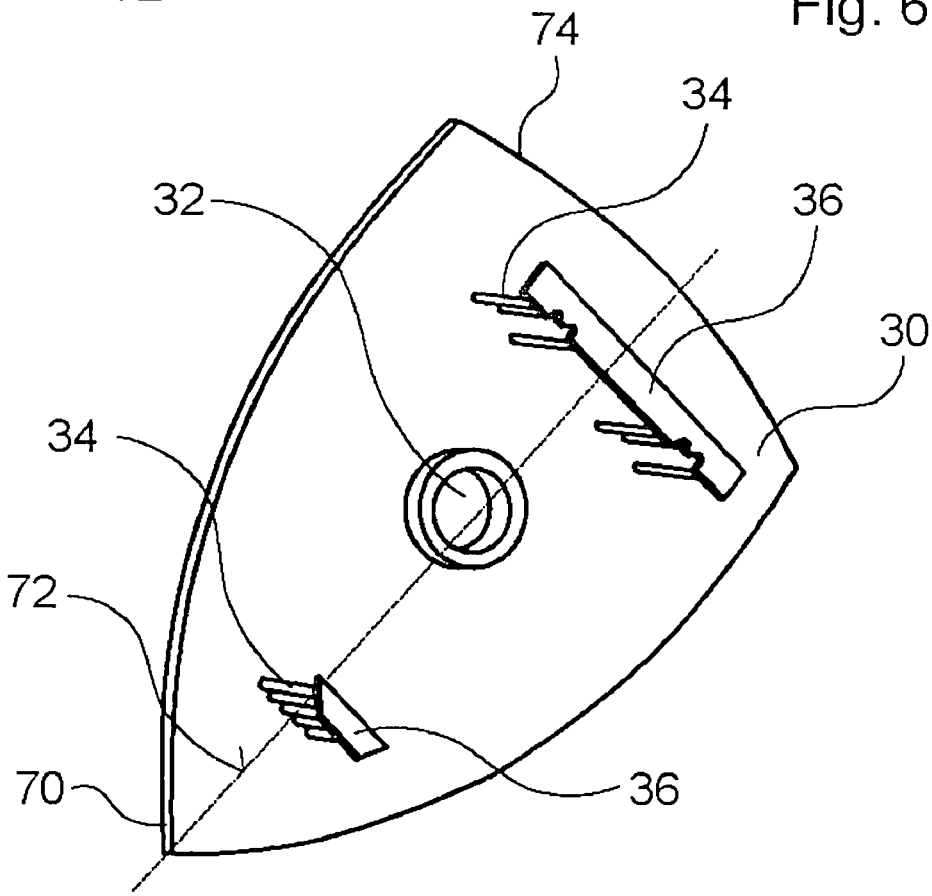

FIGS. 6 *a* and *b* show a preferred sanding plate 30. The sanding plate 30 is integrally joined to its support flange 32, to oscillation feet 34, and to their mounts 36 oriented toward the housing. The underside of the sing plate 30 is provided with a grid structure that provides the maximum of reinforcement with a low weight (FIG. 6 *a*. The sanding plate 30 is smooth on top and oscillation feet 34 are situated on both sides of the support flange 32, along a symmetry axis 72 extending from a tip 70 (FIG. 6 *a*).

Figure 7A:
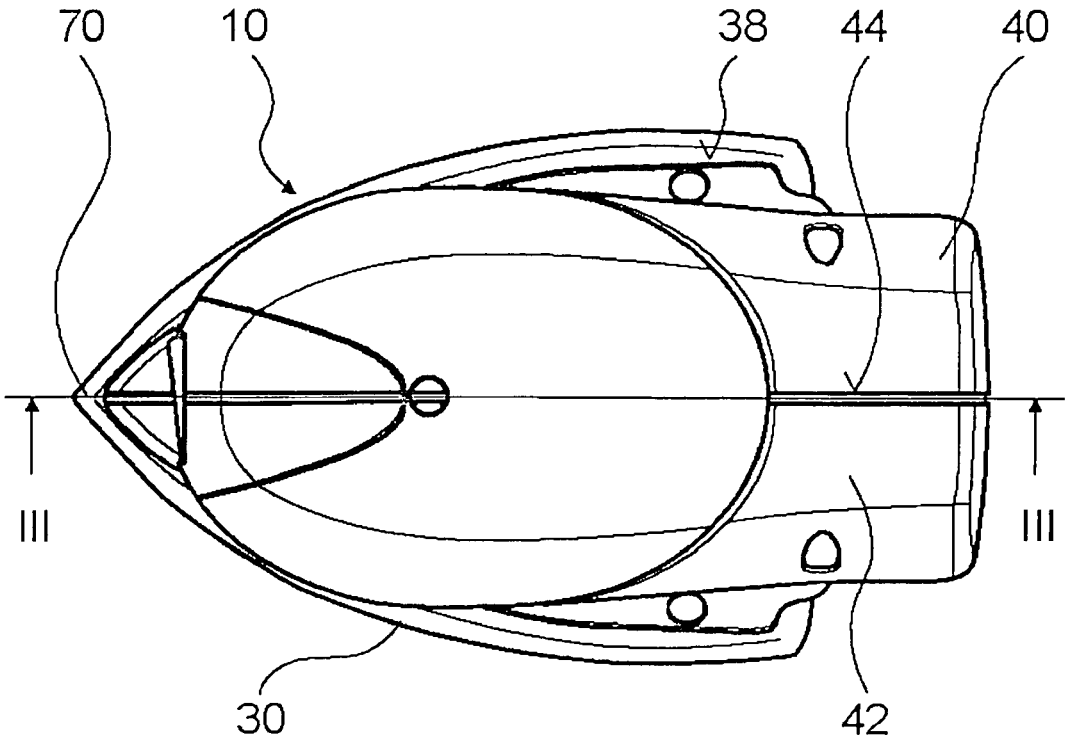
Figure 7B:
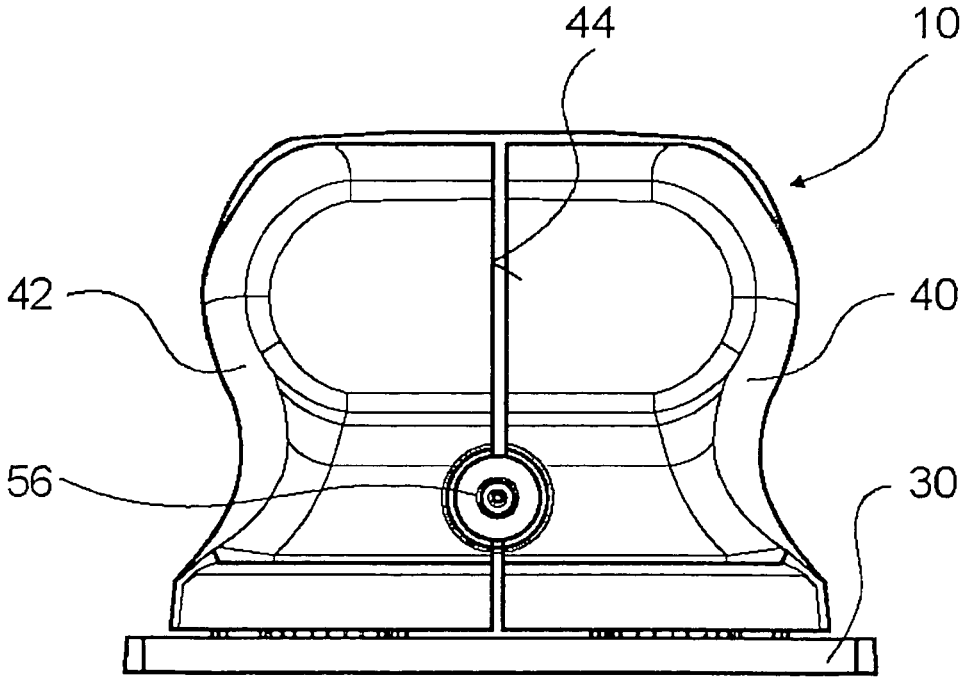

FIGS. 7 *a* and *b* show a top view and a rear view of the sander 10. It is clear from FIG. 7 *a* that the housing 10 is divided into two casing halves 40, 42 attached to each other with a weld 44. Preferably, the casing halves 40, 42 are embodied in the form of plastic casing halves. In the top view, it is clear that the size of the housing 12 is essentially limited to that of a base 38 of a sanding plate 30. Only at its blunt end 74 does the housing 12 jut out slightly over the base 38. The rear view (FIG. 4 *b*) shows a squat housing form with indentations on the side that make the sander 10 easy to grip in an operator's hand.

The invention also relates to a charger 88 (FIG. 8), which is embodied, for example, in the form of an inexpensive one hour charger with a conventional charging current of 200 mA to 300 mA and which is designed to adapt to a wall outlet.

Figure 8:
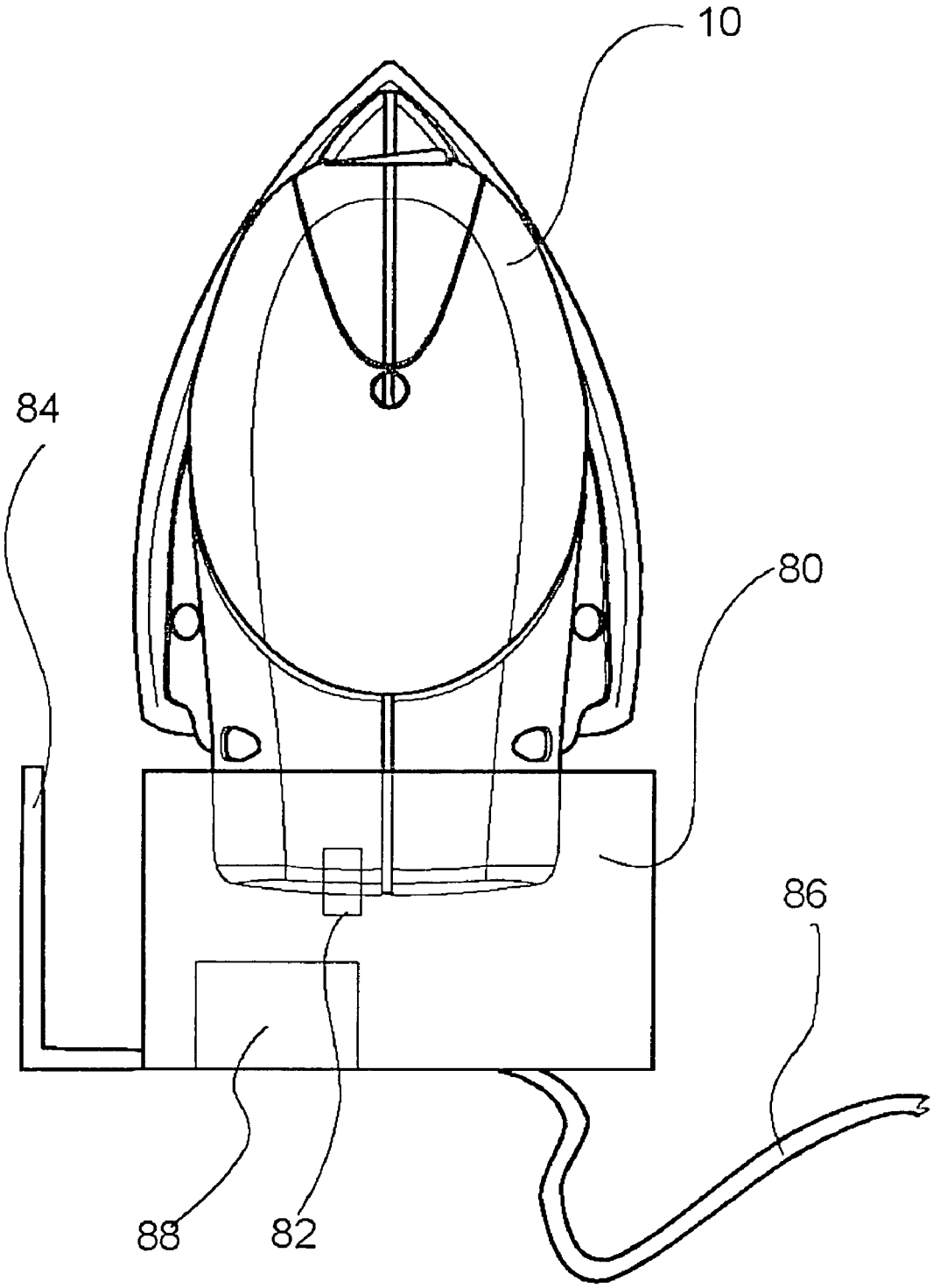
FIG. 8 is a view of a preferred sander cradle with a charger and an inserted sander.

FIG. 8 also shows a sander cradle 80 that the sander 10 can be hung onto or inserted into for storage purposes, for recharging purposes, and/or for temporarily storing it during pauses while sanding. The sander cradle 80 includes the charger 88 and has a cable 86 for connecting the charger 88 to a power grid so that when the sander 10 is placed in the sander cradle 80, the rechargeable battery unit 28 of the sander 10 is automatically recharged, for example by means of a charger connection 82. The sander cradle 80 can advantageously also be used to store sanding accessories such as sheets of sandpaper. A holder 84 is provided for this purpose.

If a power cable, not shown here, is plugged into the electrical connection 56, then the sander 10 automatically switches into a power grid-supplied operating mode in which an operating voltage supply is provided by the power grid via the electrical connection 56 and in which the rechargeable battery unit 28 is uncoupled.

What is claimed is:

1. A hand-guided sander comprising:

a housing (12);

a sanding plate (30) which has a base (38);

a center of mass (78);

a sanding drive unit (16) for driving the sanding plate (30); and a rechargeable battery unit (28);

wherein a size of the housing (12) is essentially limited to that of the base (38) of the sanding plate (30), wherein the housing (12) is equipped to accommodate the rechargeable battery unit (28), wherein the sanding plate (30) has a symmetry axis (72) which extends through the center of mass (78) and on which a support point (76) of the sanding plate (30) for the sanding drive (16) is situated, wherein the sanding plate (30) is delta-shaped, wherein the symmetry axis (72) of the sanding plate (30) extends from a tip (70) of the sanding plate (30) to a blunt end (74) of the sanding plate (30) and wherein the support point (76) of the sanding plate (30) is located between the center of mass (78) and the blunt end (74) of the sanding plate (30).

2. The sander as recited in claim 1, characterized by means of a rechargeable battery unit (28) equipped with lithium-ion cells.

3. The sander as recited in claim 1, wherein the height (26) of the housing (12) perpendicular to the base (38) is at most as great as its longitudinal span (24) along the base (38).

4. The sander as recited in claim 1, wherein the sanding plate (30) comprises a support flange (32), oscillation feet (36) and mounts (36) which are oriented towards the housing (12), and wherein the sanding plate (30) is integrally joined to the support flange (32), to the oscillation feet (34), and to the mounts (36).

5. The sander as recited in claim 1, characterized by means of a motor (14) oriented perpendicular to the sanding plate (30).

6. The sander as recited in claim 5, characterized by means of an electronic unit (18) that is oriented with a flat side (58) parallel to the sanding plate (30).

7. The sander as recited in claim 1, wherein a motor (14) is oriented parallel to the sanding plate (30).

8. The sander as recited in claim 7, characterized by means of an electronic unit (18) that is oriented with a flat side (58) perpendicular to the sanding plate (30).

9. The sander as recited in claim 1, characterized by means of a transmission (50, 52) that is situated between the motor (14) and a sanding drive unit (16) of the sanding plate (30) and has a transmission ratio of at most 3.

10. The sander as recited in claim 1, wherein the housing (12) has an electrical connection (56) for connecting to a charger (88).

11. The sander as recited in claim 10, wherein the electrical connection (56) is suitable for assuring that an operating voltage is supplied in at least one operating mode.

12. The sander as recited in claim 1, wherein the housing (12) is provided for containing at least one motor (14), the sanding drive unit (16) for the sanding plate (30), whose longitudinal span (24) is at least as great as a height (26) of the housing perpendicular to the base (46), and a receptacle for the rechargeable battery unit (28), wherein the housing (12) further comprises a divided plastic casing, having a first and second housing part (40, 42), in which means are provided for the insertion of the motor (14) and/or the electric unit (18) and/or the rechargeable battery unit (28) and/or a transmission (50, 52) and/or the sanding drive unit (16) for the sanding plate (30), and wherein the housing (12) juts out slightly over the base (38) at the blunt end (74) of the sanding plate (30).

* * * * *